US009862904B2

(12) United States Patent
Landschof

(10) Patent No.: US 9,862,904 B2
(45) Date of Patent: Jan. 9, 2018

(54) UNLEADED FUEL COMPOSITIONS

(71) Applicant: SHELL OIL COMPANY, Houston, TX (US)

(72) Inventor: Jörg Landschof, Hamburg (DE)

(73) Assignee: SHELL OIL COMPANY, Houston, TX (US)

( * ) Notice: Subject to any disclaimer, the term of this patent is extended or adjusted under 35 U.S.C. 154(b) by 289 days.

(21) Appl. No.: 14/580,782

(22) Filed: Dec. 23, 2014

(65) Prior Publication Data

US 2015/0184095 A1 Jul. 2, 2015

(30) Foreign Application Priority Data

Dec. 31, 2013 (EP) ..... 13199904

(51) Int. Cl.

| | |
|---|---|
| ***C10L 1/02*** | (2006.01) |
| ***C10L 10/10*** | (2006.01) |
| ***F02B 43/02*** | (2006.01) |
| *C10L 1/16* | (2006.01) |

(52) U.S. Cl.

CPC ..... *C10L 1/023* (2013.01); *C10L 10/10* (2013.01); *F02B 43/02* (2013.01); *C10L 1/1608* (2013.01); *C10L 1/1691* (2013.01); *C10L 2200/0415* (2013.01); *C10L 2200/0461* (2013.01); *C10L 2200/0469* (2013.01); *C10L 2230/22* (2013.01); *C10L 2270/023* (2013.01)

(58) Field of Classification Search

CPC .. C10L 1/023; C10L 10/10; C10L 2200/0469; C10L 2230/22; C10L 2270/023; C10L 1/1608; C10L 1/1691; C10L 2200/0415; C10L 2200/0461; F02B 43/02

See application file for complete search history.

(56) References Cited

U.S. PATENT DOCUMENTS

| | | | | |
|---|---|---|---|---|
| 4,849,572 | A | 7/1989 | Chen et al. | |
| 4,877,416 | A | 10/1989 | Campbell | |
| 5,855,629 | A | 1/1999 | Grundy et al. | |
| 2010/0018112 | A1* | 1/2010 | Russo | C10L 1/023 44/451 |
| 2012/0247003 | A1 | 10/2012 | Baustian et al. | |
| 2012/0266838 | A1 | 10/2012 | Gosselink et al. | |
| 2013/0139431 | A1* | 6/2013 | Russo | C10L 1/1824 44/451 |
| 2013/0225463 | A1 | 8/2013 | Hansch et al. | |
| 2013/0296210 | A1 | 11/2013 | Hansch et al. | |
| 2015/0184097 | A1 | 7/2015 | Landschof | |

FOREIGN PATENT DOCUMENTS

| | | |
|---|---|---|
| DE | 3826608 | 2/1990 |
| DE | 3838918 | 5/1990 |
| DE | 4142241 | 6/1993 |
| DE | 4309074 | 9/1994 |
| DE | 19620262 | 11/1997 |
| DE | 10102913 | 7/2002 |
| EP | 310875 | 4/1989 |
| EP | 356725 | 3/1990 |
| EP | 452328 | 3/1991 |
| EP | 548617 | 6/1993 |
| EP | 700985 B1 | 3/1996 |
| EP | 831141 | 3/1998 |
| GB | 2493377 | 2/2013 |
| WO | 1994024231 | 10/1994 |
| WO | 1997003946 | 2/1997 |
| WO | 2003076554 | 9/2003 |
| WO | 2006135881 | 12/2006 |
| WO | 2009050287 | 4/2009 |
| WO | 2010014501 | 2/2010 |
| WO | 2011149799 | 12/2011 |
| WO | 2012163935 | 12/2012 |

OTHER PUBLICATIONS

Gary, J. et al.' "Petroleum Refining, Technology and Economics"; 2nd Ed. Chapter 10; pp. 159-183; 1984.

Kirk Othmer. Concise Encyclopedia of Chemical Technology; 4th Ed. vol. 1; pp. 75-76; 1999.

Topgul, Tolga et al.; The effects of ethanol-unleaded gasoline blends and ignition timing on engine performance and exhaust emissions, Renewable Energy, vol. 31, pp. 2534-2542, 2006.

EP Search Report dated Jun. 8, 2015 for EP 14200243.5.

* cited by examiner

*Primary Examiner* — Cephia D Toomer

(57) ABSTRACT

Unleaded fuel compositions is provided which comprise:

15 to 20 volume % of one or more alkanols having from 2 to 4 carbon atoms;

20 to 75 volume % of one or more branched paraffins having from 5 to 10 carbon atoms;

0 to 25 volume % of one or more linear or branched olefins;

0 to 35 volume % of one or more mono-alkylated benzenes,

The unleaded fuel composition increase engine efficiency or the brake specific fuel consumption of an engine when used.

19 Claims, No Drawings

UNLEADED FUEL COMPOSITIONS

The present non-provisional application claims priority from European Patent Application No. 13199904.7 filed Dec. 31, 2013, the entire disclosure of which is hereby incorporated by reference.

FIELD OF THE INVENTION

The present application relates to high octane unleaded fuel compositions.

BACKGROUND OF THE INVENTION

In the operation of spark-induced or spark-ignition combustion engines, and particularly automotive engines operating on gasoline, the octane number of the fuel must be high enough to prevent knocking. Gasolines sold at service stations typically have an octane number of from 87 to 93. Fuels having such octane numbers are satisfactory for most automotive engines.

For high performance engines, and for racing engines in particular, fuels of even higher octane numbers are required. The lower the octane number, the more likely it is that knocking will occur. The production of fuels of progressively higher octane values is progressively more difficult to achieve. In particular, fuels having an octane value at or above 100 are highly desired and the most difficult to produce. This is particularly true for unleaded fuels.

Current racing fuels, and particularly racing fuels for endurance racing, require not just high octane but optimized engine and fuel efficiency.

Currently many countries also impose a requirement in gasolines of an amount of bio-component: a component that has been derived from biological sources such as cellulose or plant materials, rather than from crude oil. It is expected that both racing fuel technical specifications, and eventually legislation, will require increased amounts of bio-component.

Common bio-components include alkanols, such as methanol and ethanol, obtained from natural sources, such as plant products and often termed, for example, bio-methanol and bio-ethanol.

WO 2010/014501 proposes an unleaded fuel composition comprising:

45 volume % or more of one or more branched paraffins;

34 volume % or less of one or more mono- and di-alkylated benzenes;

from 5 to 6 volume % of one or more linear paraffins having from 3 to 5 carbon atoms; and, one or more alkanol having from 2 to 4 carbon atoms in an amount sufficient to boost the octane number of the unleaded fuel composition to 93 or greater, the unleaded fuel composition being free of any other ingredient or combination of ingredients that increases the octane number of the unleaded fuel composition by more than 1.0 unit.

The primary source for the branched paraffin component exemplified is refinery alkylate. The alkanol (bio) component exemplified is ethanol and used in an amount of 10 vol. % of total composition, excluding any fuel additive.

SUMMARY OF THE INVENTION

A need exists for unleaded fuel compositions with high octane numbers that comprise less than 50 volume % aromatics and that can accommodate high bio-content amounts to meet future legislation, and allow a high and ideally increased fuel and engine efficiency. There is also advantage in reducing the content of refinery alkylate and providing a fully synthetic fuel, for example a synthetic gasoline.

According to the present invention there is provided an unleaded fuel comprising:

15 to 20 volume % of one or more alkanols having from 2 to 4 carbon atoms;

20 to 75 volume % of one or more branched paraffins having from 5 to 10 carbon atoms;

0 to 25 volume % of one or more linear or branched olefins;

0 to 35 volume % of one or more mono-alkylated benzenes.

Most suitably, the combination of the above components totals 100 volume %, based on total volume of the fuel composition excluding any fuel additives present.

In another embodiment, a method for increasing engine efficiency is provided, the method comprising burning the unleaded fuel composition in an engine, preferably a spark ignition engine.

In another embodiment, a method for reducing the brake specific fuel consumption of an engine, the method comprising burning the unleaded fuel composition in an engine, preferably a spark ignition engine.

DETAILED DESCRIPTION OF THE INVENTION

The present invention further provides a method for increasing engine efficiency, the method comprising burning the unleaded fuel composition in the engine; and use of the unleaded fuel composition of the invention for reducing the brake specific fuel consumption of an engine.

Unleaded Fuel Composition

The fuel composition of the present invention is a gasoline fuel composition suitable for a spark ignition engine. It most suitably has a low or ultra low sulphur content, for instance at most 1000 ppmw (parts per million by weight), preferably no more than 500 ppmw, more preferably no more than 100, even more preferably no more than 50 and most preferably no more than even 10 ppmw.

The gasoline also preferably is synthetic, i.e. none of the components are refinery streams, and therefore has a low total lead content, such as at most 0.005 g/l, and is most preferably lead free—having no lead compounds added thereto (i.e. unleaded).

Octane Number

The octane number of a fuel composition can be measured as Research Octane Number (RON) and/or Motor Octane Number (MON); an octane number may also be calculated as the sum of the Research Octane Number (RON) and the Motor Octane Number (MON) divided by 2, i.e., (R+M)/2. Unless otherwise indicated, the Research Octane Number (RON) is determined according to method ASTM D-2699-04a (2004) and the Motor Octane Number (MON) is determined according to method ASTM D-2700-04a (2004), both incorporated by reference.

The unleaded fuel compositions of the present application have octane numbers that are higher than those observed for most commercially available unleaded fuels. It is advantageous for the unleaded fuel composition to have an octane number sufficiently high to prevent the engine from knocking.

In one embodiment, the unleaded fuel compositions have an octane number of 100 or more, preferably a RON of 100 or more.

In one embodiment, the unleaded fuel compositions have an octane number of 103 or more, preferably a RON of 103 or more.

In one embodiment, the unleaded fuel compositions have an octane number of 105 or more, preferably a RON of 105 or more.

Alkanol

The unleaded fuel composition contains in the range of from about 15 to about 25 volume % of one or more alkanols having from 2 to 4 carbon atoms.

The alkanol having from 2 to 4 carbon atoms may be methanol, ethanol, propanol or butanol, and is preferably ethanol.

Preferably the amount of alkanol in the fuel composition of the present invention is about 20 volume % of total fuel composition.

The ethanol used may suitably be any fuel-grade ethanol from any suitable source and is most suitably bio-ethanol. Suitable ethanol is readily available commercially.

Branched Paraffin

The fuel composition of the present invention contains in the range of from about 20 to about 75 volume % of one or more branched paraffins having from 5 to 10 carbon atoms.

The amount of branched paraffins may be 25 vol. %, or 50 vol. % or more, or 70 vol. % or more branched paraffins.

In one embodiment, the blend comprises about 29 vol. % branched paraffins. In one embodiment, the blend comprises about 53 vol. % branched paraffins. In one embodiment, the blend comprises about 70 vol. % branched paraffins.

The branched paraffins found to be most useful in the present invention are iso-paraffins, also termed iso-alkanes.

Most suitably a mixture of branched paraffins may be used in the fuel composition of the invention. A mixture of branched paraffins having from 5 carbon atoms to 10 carbon atoms has been found to give good results. Most suitably the mixture may be made up of iso-pentane, iso-octane and a mixture of branched paraffins having from 7 to 10 carbon atoms.

Various grades of branched chain iso-paraffins and mixtures are commercially available. The grade typically is identified by the range of the number of carbon atoms per molecule, the average molecular weight of the molecules, and/or the boiling point range. For example a mixture of paraffins having from 7 carbon atoms to 10 carbon atoms is commercially available under the trade name Isopar E.

In one embodiment a mixture of 25 volume % of Isopar E with about 4 volume % of iso-pentane is used. In another embodiment a combination of 18 volume % Isopar E, 27 volume % iso-octane, and 8 volume % of iso-pentane is used. In a further embodiment 28 volume % of Isopar E, 25 volume % iso-octane, and 17 volume % of iso-pentane is used.

It may commercially be useful to replace all or part of the branched paraffin component with an amount of an alkylate stream.

The term "alkylate" is typically also used to refer to branched-chain paraffins, derived from the alkylation processes used in oil refining. Alkylation is described, for example, in J. Gary, et al. *Petroleum Refining, Technology and Economics* (2d Ed. 1984) Chapter 10, pp. 159-183, and in Kirk Othmer. *Concise Encyclopedia of Chemical Technology* ($4^{th}$ Ed. 1999) Vol. 1, p. 75-76.

As used herein, the word "alkylate" refers to hydrocarbon compositions used for fuel applications comprising 90 volume % or more iso-paraffins, as measured according to ASTM D5134-98 (2003). In one embodiment, the alkylate also meets one or more of the following parameters, as measured according to ASTM D5134-98 (2003): comprises less than 2 volume % paraffins; comprises less than 1 volume % olefins; comprises less than 5 volume % naphthenes; comprises less than 3 volume % aromatics; comprises less than 0.3 volume % molecules with 14 or more carbon atoms; has an initial boiling point of 96° C.; and, has a final boiling point of 394° C. In one embodiment, the alkylate has an API gravity of 69° API, as measured according to ASTM D4052(IP365)-96 (1996). In one embodiment, the alkylate has a dry vapor pressure of from 27.6 kPa (4 psi) to 35 kPa (5 psi), as measured according to ASTM D5191-EPA-07 (2007). In one embodiment, the alkylate is a refinery grade alkylate formed by the reaction of isobutene with 1-butene in the presence of a strongly acidic catalyst.

Suitable alkylate typically has a RON of, for example, from 93 to 95. Suitable alkylate typically has a MON of, for example, from 91 to 92. Suitable alkylate typically has an octane number (R+M/2) of, for example, from 92 to 93.5.

Suitable alkylates can be obtained from a variety of sources, including Solvents & Chemicals, Pearland, Tex.; Equistar Chemicals; Texas Petrochemicals; Shell Chemical Company; and, various refineries.

Linear or Branched Olefin

The fuel composition of the invention may contain up to about 25 volume % of one or more linear or branched olefins.

An olefin is an unsaturated hydrocarbon compound that contains one or more carbon-carbon double bonds. Most suitably, olefins selected from those having only one carbon-carbon double bond are utilized in the fuel composition of the invention.

In one embodiment the one or more linear or branched olefins have from 4 to 10, for example 4 to 8, carbon atoms. Suitably only branched olefins are utilized. Most suitably branched olefins having from 5 to 7 carbon atoms are utilized.

Examples include liquid alkene having from 5 to 10 carbon atoms. Specific examples of suitable liquid alkenes include pentene, iso-pentene, hexene, iso-hexene, heptene, and mixtures thereof.

Particularly useful examples are di-iso-butylene, 2-methyl-2-butene, and mixtures thereof.

In one embodiment, the unleaded fuel composition comprises up to about 20 vol. % of branched olefins having from 5 to 7 carbon atoms.

In one embodiment, the fuel composition contains about 17 vol. % of 2-methyl-2-butene; in a further embodiment no branched olefins are utilized. In a third embodiment, about 7 vol. % of di-iso-butylene and about 10 vol. % of 2-methyl-2-butene are utilized.

Alkylated Benzenes

The fuel composition of the invention may contain up to about 35 volume % of one or more alkylated benzenes, most suitably mono-alkylated benzenes.

Alkylated benzenes may be mono-, di- or tri-alkylated benzenes, and may be, for example, xylenes, or toluene.

The unleaded fuel composition may contain 20 vol. % or less, or 10 vol. % or less, of one or more alkylated benzenes. Most suitably the fuel composition contains in the range of from about 5 to about 25 volume % of alkylated benzene.

In one embodiment, the unleaded fuel composition contains about 34 vol. % of one or more alkylated benzenes. In one embodiment, the unleaded fuel composition comprises about 10 vol. % of one or more alkylated benzenes.

Suitable alkylated benzenes have the following general structure:

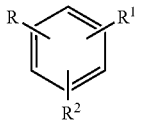

wherein R, $R^1$, and $R^2$ are selected from the group consisting of hydrogen and alkyl groups having from 1 to 4 carbon atoms, provided that at least one of R, $R^1$, and $R^2$ is an alkyl group. In one embodiment, R, $R^1$, and $R^2$ are selected from the group consisting of hydrogen and alkyl groups having from 1 to 2 carbon atoms. In one embodiment, R, $R^1$, and $R^2$ are selected from the group consisting of hydrogen and methyl groups. In one embodiment, the alkylated benzene is mono-alkylated benzene. In one embodiment, one or more of R, $R^1$, and $R^2$ are methyl groups.

Most suitably only one or more mono-alkylated benzenes are utilised in the fuel composition of the invention.

In one embodiment, the unleaded fuel composition contains toluene.

Toluene

Toluene is a mono-substituted benzene having the following structure:

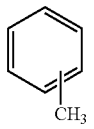

In one embodiment, the unleaded fuel composition contains up to 35 vol. % of toluene. In one embodiment, the unleaded fuel composition contains up to 20 vol. % of toluene, in a third embodiment it contains up to 10 vol. % of toluene.

In one embodiment, the unleaded fuel composition contains about 34 vol. % of toluene. In one embodiment, the unleaded fuel composition contains about 10 vol. % of toluene.

Specific Formulations

In one embodiment, the application provides an unleaded fuel composition comprising: about 20 volume % of one or more alkanol having from 2 to 4 carbon atoms, preferably ethanol; about 10 volume % of one or more mono-alkylated benzenes, preferably toluene; and about 70 volume % of one or more branched paraffins.

In one embodiment, the application provides an unleaded fuel composition comprising: about 20 volume % of one or more alkanol having from 2 to 4 carbon atoms, preferably ethanol; about 10 volume % of one or more mono-alkylated benzenes, preferably toluene; about 53 volume % of one or more branched paraffins; and about 17 volume % of branched olefins.

In one embodiment, the application provides an unleaded fuel composition comprising: about 20 volume % of one or more alkanol having from 2 to 4 carbon atoms, preferably ethanol; about 34 volume % of one or more mono-alkylated benzenes, preferably toluene; about 29 volume % of one or more branched paraffins; and about 17 volume % of branched olefins.

The unleaded fuel composition of the present invention is most suitable for use in racing applications, for example in endurance racing or high speed racing applications.

In one embodiment, the unleaded fuel compositions may produce a higher maximum power output value than commercially available unleaded fuels, for example those having an octane number of 93 or more.

Other Components

Most suitably the only other components in a fuel composition of the present invention are one or more fuel additives. However further bio-components, such as oxygenated hydrocarbons other than alkanols, may be utilized if required by legislation.

When the gasoline comprises oxygenated hydrocarbons, at least a portion of non-oxygenated hydrocarbons will be substituted for oxygenated hydrocarbons. The oxygen content of the gasoline may be up to 35 percent by weight (EN 1601) (e.g. ethanol per se) based on the gasoline. For example, the oxygen content of the gasoline may be up to 25 percent by weight, preferably up to 10 percent by weight. Conveniently, the oxygenate concentration will have a minimum concentration selected from any one of 0, 0.2, 0.4, 0.6, 0.8, 1.0, and 1.2 percent by weight, and a maximum concentration selected from any one of 5, 4.5, 4.0, 3.5, 3.0, and 2.7 percent by weight.

Examples of additional oxygenated hydrocarbons that may be incorporated into the gasoline include ethers, esters, ketones, aldehydes, carboxylic acids and their derivatives, and oxygen containing heterocyclic compounds. Preferably, the oxygenated hydrocarbons that may be incorporated into the gasoline are selected from ethers (preferably ethers containing 5 or more carbon atoms per molecule, e.g., methyl tert-butyl ether and ethyl tert-butyl ether) and esters (preferably esters containing 5 or more carbon atoms per molecule). Most suitably however there is no other oxygenated hydrocarbon present than the alkanol, e.g. ethanol component.

Conveniently, if such hydrocarbon present, the gasoline may contain at least 0.5, 1.0 or 2.0 percent by volume of additional oxygenated hydrocarbons.

The unleaded fuel composition optionally may comprise a variety of other components conventional for use as additives in fuel compositions, and particularly in gasolines.

In one embodiment, the unleaded fuel composition comprises corrosion inhibitor. Suitable corrosion inhibitors include, for example, carboxylic acids, esters, alkanolamides, amines, etc.

The unleaded fuel composition also may comprise other additives or components. Refinery streams that may be used in the unleaded fuel include, for example, distillation products and reaction products from a refinery such as catalytic reformate, heavy catalytic cracked spirit, light catalytic cracked spirit, straight run gasoline, isomerate, light reformate, light hydrocrackate, and naphtha. However, preferably no refinery stream is used in the fuel composition of the invention.

The fuel also may contain lead replacement additives and/or other common additives, for example, dyes, deicing agents, agents for preventing exhaust valve seat wear, antioxidants, corrosion inhibitors, anti-static additives, detergents and the like.

The unleaded fuel composition may contain one or more such fuel additives. Where used, the unleaded fuel composition typically comprises 3500 ppm or less, preferably 3000 ppm or less, most suitably 2000 ppm or less and may contain 1000 ppm or less, total amount of additives. Where one or more additives are present, each additive typically is present in an amount of 0.1 ppm or more. In one embodiment, each additive is present in an amount of 200 ppm or more. In one embodiment, each additive is present in an amount of 1 ppm or more. In one embodiment, each additive is present in an amount of about 3000 pm or less. In one embodiment, each additive is present in an amount of 100 ppm or less; in another embodiment in an amount of 50 ppm or less. In one embodiment, each additive is present in an amount of 20 ppm or less.

Preferably, the amount of additive present in the fuel composition of the present invention is in the range of 15 ppmw (parts per million by weight) to 10% wt, based on the overall weight of the liquid fuel composition. More preferably, the total amount of additives, for example as part of a performance package, present in the liquid fuel composition of the present invention additionally accords with one or more of the parameters (i) to (xv) listed below:

(i) at least 100 ppmw
(ii) at least 200 ppmw
(iii) at least 300 ppmw
(iv) at least 400 ppmw
(v) at least 500 ppmw
(vi) at least 600 ppmw
(vii) at least 700 ppmw
(viii) at least 800 ppmw
(ix) at least 900 ppmw
(x) at least 1000 ppmw
(xi) at least 2500 ppmw
(xii) at most 3000 ppmw
(xiii) at most 5000 ppmw
(xiv) at most 10000 ppmw
(xv) at most 2% wt.
(xvi) at most 5% wt.

In one embodiment, the unleaded fuel composition comprises lead replacement additive. In one embodiment, the unleaded fuel composition comprises antioxidant. In one embodiment, the unleaded fuel composition comprises detergent additive. In one embodiment, the unleaded fuel composition comprises a combination of antioxidant and detergent additives.

Where used, the unleaded fuel composition typically comprises, for example, 20 mg/kg or more lead replacement additive. In one embodiment, the unleaded fuel composition comprises from 25 mg/kg or more lead replacement additive. In one embodiment, the unleaded fuel composition comprises 30 mg/kg or more lead replacement additive. In one embodiment, the unleaded fuel composition comprises 60 mg/kg or less lead replacement additive. In one embodiment, the unleaded fuel composition comprises 55 mg/kg or less lead replacement additive. In one embodiment, the unleaded fuel composition comprises 50 mg/kg or less lead replacement additive.

Non-limiting examples of suitable types of fuel additives that can be included in the fuel composition, or gasoline, or in a performance additive package, or the fuel composition include anti-oxidants, corrosion inhibitors, detergents, dehazers, antiknock additives, metal deactivators, valve-seat recession protectant compounds, dyes, solvents, carrier fluids, diluents and markers. Examples of suitable such additives are described generally in U.S. Pat. No. 5,855,629.

Conveniently, the fuel additives can be blended with one or more solvents to form an additive concentrate, the additive concentrate can then be admixed with the other components of the gasoline or fuel composition of the present invention.

The (active matter) concentration of any optional additives present in the fuel composition or the gasoline composition of the present invention is preferably up to 1 percent by weight, more preferably in the range from 5 to 3000 ppmw, for example to 2000 ppmw, and possibly in the range of from 200 to 3000 ppmw, such as from 300 to 1000 ppmw.

The performance additive package and therefore the fuel composition of the invention may also contain synthetic or mineral carrier oils and/or solvents. Suitably synthetic carrier oils are used.

Examples of suitable mineral carrier oils are fractions obtained in crude oil processing, such as brightstock or base oils having viscosities, for example, from the SN 500-2000 class; and also aromatic hydrocarbons, paraffinic hydrocarbons and alkoxyalkanols. Also useful as a mineral, carrier oil is a fraction which is obtained in the refining of mineral oil and is known as "hydrocrack oil" (vacuum distillate cut having a boiling range of from about 360 to 500° C., obtainable from natural mineral oil which has been catalytically hydrogenated under high pressure and isomerized and also deparaffinized).

Examples of suitable synthetic carrier oils are: polyolefins (poly-alpha-olefins or poly(internal olefin)s), (poly)esters, (poly)alkoxylates, polyethers, aliphatic polyether amines, alkylphenol-started polyethers, alkylphenol-started polyether amines and carboxylic esters of long-chain alkanols.

Examples of suitable polyolefins are olefin polymers, in particular based on polybutene or polyisobutene (hydrogenated or nonhydrogenated).

Examples of suitable polyethers or polyetheramines are preferably compounds comprising polyoxy-$C_2$-$C_4$-alkylene moieties which are obtainable by reacting $C_2$-$C_{60}$-alkanols, $C_6$-$C_{30}$-alkanediols, mono- or di-$C_2$-$C_{30}$-alkylamines, $C_1$-$C_{30}$-alkylcyclohexanols or $C_1$-$C_{30}$-alkylphenols with from 1 to 30 mol of ethylene oxide and/or propylene oxide and/or butylene oxide per hydroxyl group or amino group, and, in the case of the polyether amines, by subsequent reductive amination with ammonia, monoamines or polyamines. Such products are described in particular in EP-A-310 875, EP-A-356 725, EP-A-700 985 and U.S. Pat. No. 4,877,416. For example, the polyether amines used may be poly-$C_2$-$C_6$-alkylene oxide amines or functional derivatives thereof. Typical examples thereof are tridecanol butoxylates or isotridecanol butoxylates, isononylphenol butoxylates and also polyisobutenol butoxylates and propoxylates, and also the corresponding reaction products with ammonia.

Examples of carboxylic esters of long-chain alkanols are in particular esters of mono-, di- or tricarboxylic acids with long-chain alkanols or polyols, as described in particular in DE-A-38 38 918. The mono-, di- or tricarboxylic acids used may be aliphatic or aromatic acids; suitable ester alcohols or polyols are in particular long-chain representatives having, for example, from 6 to 24 carbon atoms. Typical representatives of the esters are adipates, phthalates, isophthalates, terephthalates and trimellitates of isooctanol, isononanol, isodecanol and isotridecanol, for example di-(n- or isotridecyl) phthalate.

Further suitable carrier oil systems are described, for example, in DE-A-38 26 608, DE-A-41 42 241, DE-A-43 09 074, EP-A-0 452 328 and EP-A-0 548 617, which are incorporated herein by way of reference.

Examples of particularly suitable synthetic carrier oils are alcohol-started polyethers having from about 5 to 35, for example from about 5 to 30, $C_3$-$C_6$-alkylene oxide units, for example selected from propylene oxide, n-butylene oxide and isobutylene oxide units, or mixtures thereof. Non-limiting examples of suitable starter alcohols are long-chain alkanols or phenols substituted by long-chain alkyl in which the long-chain alkyl radical is in particular a straight-chain or branched $C_6$-$C_{18}$-alkyl radical. Preferred examples include tridecanol and nonylphenol.

Further suitable synthetic carrier oils are alkoxylated alkylphenols, as described in DE-A-10 102 913.6.

Mixtures of mineral carrier oils, synthetic carrier oils, and mineral and synthetic carrier oils may also be used.

Any solvent and optionally co-solvent suitable for use in fuels may be used. Examples of suitable solvents for use in fuels include: non-polar hydrocarbon solvents such as kerosene, heavy aromatic solvent ("solvent naphtha heavy", "Solvesso 150"), toluene, xylene, paraffins, petroleum, white spirits, those sold by Shell companies under the trademark "SHELLSOL", and the like. Examples of suitable co-solvents include: polar solvents such as esters and, in particular, alcohols (e.g. t-butanol, i-butanol, hexanol, 2-ethylhexanol, 2-propyl heptanol, decanol, isotridecanol, butyl glycols, and alcohol mixtures such as those sold by Shell companies under the trade mark "LINEVOL", especially LINEVOL 79 alcohol which is a mixture of $C_{7-9}$ primary alcohols, or a $C_{12-14}$ alcohol mixture which is commercially available).

Dehazers/demulsifiers suitable for use in liquid fuels are well known in the art. Non-limiting examples include glycol oxyalkylate polyol blends (such as sold under the trade designation TOLAD™ 9312), alkoxylated phenol formaldehyde polymers, phenol/formaldehyde or $C_{1-18}$ alkylphenol/-formaldehyde resin oxyalkylates modified by oxyalkylation with $C_{1-18}$ epoxides and diepoxides (such as sold under the trade designation TOLAD™ 9308), and $C_{1-4}$ epoxide copolymers cross-linked with diepoxides, diacids, diesters, diols, diacrylates, dimethacrylates or diisocyanates, and blends thereof. The glycol oxyalkylate polyol blends may be polyols oxyalkylated with $C_{1-4}$ epoxides. The $C_{1-18}$ alkylphenol phenol/-formaldehyde resin oxyalkylates modified by oxyalkylation with $C_{1-18}$ epoxides and diepoxides may be based on, for example, cresol, t-butyl phenol, dodecyl phenol or dinonyl phenol, or a mixture of phenols (such as a mixture of t-butyl phenol and nonyl phenol). The dehazer should be used in an amount sufficient to inhibit the hazing that might otherwise occur when the fuel composition, e.g., gasoline, without the dehazer contacts water, and this amount will be referred to herein as a "haze-inhibiting amount." Generally, this amount is from about 0.1 to about 20 ppmw (e.g. from about 0.1 to about 10 ppm), more preferably from 1 to 15 ppmw, still more preferably from 1 to 10 ppmw, advantageously from 1 to 5 ppmw based on the weight of the gasoline.

Further customary additives for use in gasolines are corrosion inhibitors, for example based on ammonium salts of organic carboxylic acids, said salts tending to form films, or of heterocyclic aromatics for nonferrous metal corrosion protection; antioxidants or stabilizers, for example based on amines such as phenyldiamines, e.g. p-phenylenediamine, N,N'-di-sec-butyl-p-phenyldiamine, dicyclohexylamine or derivatives thereof or of phenols such as 2,4-di-tert-butylphenol or 3,5-di-tert-butyl-4-hydroxy-phenylpropionic acid; anti-static agents; metallocenes such as ferrocene; methylcyclopentadienylmanganese tricarbonyl; lubricity additives, such as certain fatty acids, alkenylsuccinic esters, bis(hydroxyalkyl) fatty amines, hydroxyacetamides or castor oil; and also dyes (markers). Amines may also be added, if appropriate, for example as described in WO 03/076554. Optionally anti valve seat recession additives may be used such as sodium or potassium salts of polymeric organic acids.

The gasoline or fuel compositions herein may also comprise a detergent additive. Suitable detergent additives include those disclosed in WO2009/50287, incorporated herein by reference.

Preferred detergent additives for use in the gasoline composition herein typically have at least one hydrophobic hydrocarbon radical having a number-average molecular weight (Mn) of from 85 to 20 000 and at least one polar moiety selected from:

(A1) mono- or polyamino groups having up to 6 nitrogen atoms, of which at least one nitrogen atom has basic properties;

(A6) polyoxy-$C_2$-to-$C_4$-alkylene groups which are terminated by hydroxyl groups, mono- or polyamino groups, in which at least one nitrogen atom has basic properties, or by carbamate groups;

(A8) moieties derived from succinic anhydride and having hydroxyl and/or amino and/or amido and/or imido groups; and/or (A9) moieties obtained by Mannich reaction of substituted phenols with aldehydes and mono- or polyamines.

The hydrophobic hydrocarbon radical in the above detergent additives, which ensures the adequate solubility in the base fluid, has a number-average molecular weight (Mn) of from 85 to 20 000, especially from 113 to 10 000, in particular from 300 to 5000. Typical hydrophobic hydrocarbon radicals, especially in conjunction with the polar moieties (A1), (A8) and (A9), include polyalkenes (polyolefins), such as the polypropenyl, polybutenyl and polyisobutenyl radicals each having Mn of from 300 to 5000, preferably from 500 to 2500, more preferably from 700 to 2300, and especially from 700 to 1000.

Non-limiting examples of the above groups of detergent additives include the following:

Additives comprising mono- or polyamino groups (A1) are preferably polyalkenemono- or polyalkenepolyamines based on polypropene or conventional (i.e. having predominantly internal double bonds) polybutene or polyisobutene having Mn of from 300 to 5000. When polybutene or polyisobutene having predominantly internal double bonds (usually in the beta and gamma position) are used as starting materials in the preparation of the additives, a possible preparative route is by chlorination and subsequent amination or by oxidation of the double bond with air or ozone to give the carbonyl or carboxyl compound and subsequent amination under reductive (hydrogenating) conditions. The amines used here for the amination may be, for example, ammonia, monoamines or polyamines, such as dimethylaminopropylamine, ethylenediamine, diethylenetriamine, triethylenetetramine or tetraethylenepentamine. Corresponding additives based on polypropene are described in particular in WO-A-94/24231.

Further preferred additives comprising monoamino groups (A1) are the hydrogenation products of the reaction products of polyisobutenes having an average degree of polymerization of from 5 to 100, with nitrogen oxides or mixtures of nitrogen oxides and oxygen, as described in particular in WO-A-97/03946.

Further possible additives comprising monoamino groups (A1) are the compounds obtainable from polyisobutene epoxides by reaction with amines and subsequent dehydration and reduction of the amino alcohols, as described in particular in DE-A-196 20 262.

Additives comprising polyoxy-$C_2$-$C_4$-alkylene moieties (A6) are preferably polyethers or polyetheramines which are obtainable by reaction of $C_2$- to $C_{60}$-alkanols, $C_6$- to $C_{30}$-alkanediols, mono- or di-$C_2$-$C_{30}$-alkylamines, $C_1$-$C_{30}$-alkylcyclohexanols or $C_1$-$C_{30}$-alkylphenols with from 1 to 30 mol of ethylene oxide and/or propylene oxide and/or butylene oxide per hydroxyl group or amino group and, in the case of the polyether-amines, by subsequent reductive amination with ammonia, monoamines or polyamines. Such products are described in particular in EP-A-310 875, EP-A-356 725, EP-A-700 985 and U.S. Pat. No. 4,877,416. In the case of polyethers, such products also have carrier oil properties. Typical examples of these are tridecanol butoxylates, isotridecanol butoxylates, isononylphenol butoxylates and polyisobutenol butoxylates and propoxylates and also the corresponding reaction products with ammonia.

Additives comprising moieties derived from succinic anhydride and having hydroxyl and/or amino and/or amido and/or imido groups (A8) are preferably corresponding derivatives of polyisobutenylsuccinic anhydride which are obtainable by reacting conventional or highly reactive polyisobutene having Mn of from 300 to 5000 with maleic anhydride by a thermal route or via the chlorinated polyisobutene. Of particular interest are derivatives with aliphatic polyamines such as ethylenediamine, diethylenetriamine, triethylenetetramine or tetraethylenepentamine Such additives are described in particular in U.S. Pat. No. 4,849,572.

Additives comprising moieties obtained by Mannich reaction of substituted phenols with aldehydes and mono- or polyamines (A9) are preferably reaction products of polyisobutene-substituted phenols with formaldehyde and mono- or polyamines such as ethylenediamine, diethylenetriamine, triethylenetetramine, tetraethylenepentamine or dimethylaminopropylamine. The polyisobutenyl-substituted phenols may stem from conventional or highly reactive polyisobutene having Mn of from 300 to 5000. Such "polyisobutene-Mannich bases" are described in particular in EP-A-831 141.

Suitably, the detergent additive used in the fuel or gasoline compositions of the present invention contains at least one nitrogen-containing detergent, more preferably at least one nitrogen-containing detergent containing a hydrophobic hydrocarbon radical having a number average molecular weight in the range of from 300 to 5000. Preferably, a nitrogen-containing detergent is selected from a group comprising polyalkene monoamines, polyetheramines, polyalkene Mannich amines and polyalkene succinimides. Conveniently, the nitrogen-containing detergent may a polyalkene monoamine.

The above nitrogen containing detergents/amine detergents can be reacted to form quaternary ammonium salts which can themselves be used as alternative detergents. Suitable quaternary ammonium salts for use in gasoline fuel compositions include those disclosed in WO2006/135881, WO2011/149799, GB-A-2493377, US2013/296210 and US2013/225463.

The gasoline fuel and gasoline performance packages compositions can also comprise friction modifiers, viscosity control agents, and mixtures thereof, such as those disclosed in WO2012163935.

With reference to fuel additives as above, amounts (concentrations, % vol, ppmw, % wt) of components are of active matter, i.e. exclusive of volatile solvents/diluent materials.

ILLUSTRATIVE EXAMPLES

The present invention will now be illustrated and suitable blends further described by the following non-limiting Examples:

Examples 1 to 3

A Reference blend (Reference Example) and 3 blends according to the present invention (Examples 1 to 3) were each prepared by blending the components specified in Table 1 below.

Table 1 below provides the composition of each blend, while Table 2 below shows measured properties of each blend. In Table 1, the percentage volume of each component is the percentage of the whole composition specified. In addition, each blend contained 250 ppm of anti-oxidant and 2680 ppm of detergent which was the same in each blend. The ethanol utilized in each blend is bio-ethanol obtained from cellulose-based residue from the paper industry.

TABLE 1

| Composition | | Example | | | |
|---|---|---|---|---|---|
| | | Reference | 1 | 2 | 3 |
| Ethanol | % v | 10.4 | 20 | 20 | 20 |
| Toluene | % v | 22.5 | 10 | 10 | 34 |
| Xylene | % v | 8.9 | 0 | 0 | 0 |
| Total Aromatics | % v | 31.4 | 10 | 10 | 34 |
| Refinery Hysomerate | % v | 24.9 | 0 | 0 | 0 |
| Refinery Alkylate | % v | 33.3 | 0 | 0 | 0 |
| Isopar E* | % v | 0 | 28 | 18 | 25 |
| Iso-Octane | % v | 0 | 25 | 27 | 0 |
| Iso-Pentane | % v | 0 | 17 | 8 | 4 |
| Total Paraffins | % v | 58.2 | 70 | 53 | 29 |
| Di-iso-butylene | % v | 0 | 0 | 7 | 0 |
| 2-methyl-2-butene | % v | 0 | 0 | 10 | 17 |
| Total Olefins | % v | 0 | 0 | 17 | 17 |
| Total | % v | 100 | 100 | 100 | 100 |

*Isopar is a Trade name; Isopar E is a mixture of C7 to C10 isoparaffins and is a commercially available product.

TABLE 2

| Property | Units | Test method | Example Reference | 1 | 2 | 3 |
|---|---|---|---|---|---|---|
| Density @ 15° C. | kg/m$^3$ | ASTM D4052 | 754.8 | 728.2 | 730.0 | 767.5 |
| Distillation: | | ISO 3405 | | | | |
| E70 | % v/v | | 38.8 | 31.0 | 37.7 | 37.3 |
| E100 | % v/v | | 52.8 | 61.2 | 64.8 | 66.9 |
| Final Boiling Point | ° C. | | 162.0 | 137.1 | 129.9 | 116.6 |
| Residue | % v/v | | 1.0 | 0.9 | 0.9 | 0.7 |
| Distillation | | ASTM D86 | | | | |
| 10% | ° C. | | 55.6 | 60.7 | 60.8 | 60.1 |
| 50% | | | 98.0 | 74.4 | 73.0 | 73.7 |
| 90% | | | 126.2 | 113.5 | 109.7 | 106.4 |
| Measured octane number MON | | ASTM D2700 | 89.7 | 94.0 | 91.4 | 91.4 |
| Research octane number RON | | ASTM D2699 | 101.5 | 105.8 | 105.4 | 105.3 |
| VP (DVPE) | kPa | EN 13016-1 | 58.8 | 49.8 | 47.5 | 46.8 |
| Flame speed | | | 0.6957 | 0.735 | 0.716 | 0.716 |
| Calorific value | MJ/kg | DIN 51900-3 | 40.6 | 40.1 | 39.8 | 39.2 |
| | MJ/l | | 30.6 | 29.2 | 29.0 | 30.1 |

Discussion

Table 2 above demonstrates that it is possible to produce a synthetic gasoline fuel having a high ethanol content, an increased octane level, and an increased flame speed to enhance engine efficiency. The Examples 1 to 3 of the invention have repeatability of performance since the blend components can be controlled, whereas the Reference fuel is vulnerable to variation in performance owing to the presence of alkylate, a refinery produced material which can have varied quality and content.

Example 4—Brake Specific Fuel Consumption (BSFC)

BSFC is the rate of fuel consumption divided by the power produced and is a measure of fuel efficiency which allows different engines to be compared directly; conversely when the engine is kept the same this measure also provides a way of comparing fuels directly.

Fuel blends corresponding to those of Examples 1 to 3, i.e. having 20% v/v of ethanol, were prepared using alkylate in place of the iso-pentane, iso-octane, and Isopar E mixture. Subsequently the same fuel blends were prepared but using a different batch of alkylate. When tested for BSFC, a variation of around 5 g/kWh (grams per kilowatt-hour) was found for blends that otherwise were the same but for the different batch of alkylate.

Example 5—BSFC

The fuels of Examples 1 to 3, and a Reference fuel corresponding to the Reference Example were run through a single cylinder turbocharged engine and the BSFC measured. The results are given below; the variance for each measurement is +−1 g/kWh:

TABLE 3

| | Reference | 1 | 2 | 3 |
|---|---|---|---|---|
| BSFC | 228 | 230 | 225 | 227 |

Discussion

These results demonstrate that despite doubling the ethanol content, comparable BSFC is achievable, with the best results (i.e. the lower BSFC) being given by the fuels having an olefin content.

I claim:

1. An unleaded fuel composition comprising:

15 to 25 volume % of one or more alkanol having from 2 to 4 carbon atoms;

20 to 75 volume % of one or more branched paraffin having from 5 to 10 carbon atoms;

0 to 25 volume % of one or more linear or branched olefin;

0 to 35 volume % of one or more alkylated benzene;

wherein the unleaded fuel composition is a synthetic fuel composition.

2. The unleaded fuel composition of claim 1 comprising 20 volume % of ethanol.

3. The unleaded fuel composition of claim 1 comprising in the range of from 20 to 55 volume % of one or more branched paraffin.

4. The unleaded fuel composition of claim 2 comprising in the range of from 20 to 55 volume % of one or more branched paraffin.

5. The unleaded fuel composition of claim 1 wherein the unleaded fuel has a RON of 103 or more.

6. The unleaded fuel composition of claim 1 comprising in the range of from 10 to 20 volume % of one or more branched olefin.

7. The unleaded fuel composition of claim 2 comprising in the range of from 10 to 20 volume % of one or more branched olefin.

8. The unleaded fuel composition of claim 1 comprising in the range of from 5 to 35 volume % of one or more mono-alkylated benzene.

9. The unleaded fuel composition of claim 2 comprising in the range of from 5 to 35 volume % of one or more mono-alkylated benzene.

10. The unleaded fuel composition of claim 3 comprising in the range of from 5 to 35 volume % of one or more mono-alkylated benzene.

11. The unleaded fuel composition of claim 6 comprising in the range of from 5 to 35 volume % of one or more mono-alkylated benzene.

12. The unleaded fuel composition of claim 8 wherein the mono-alkylated benzenes is toluene.

13. The unleaded fuel composition of claim 1 further comprising one or more fuel additive.

14. The unleaded fuel composition of claim 1 comprising:

about 20 volume % ethanol about 10 volume % toluene; and about 70 volume % branched paraffins,
based on the total volume of the fuel composition excluding any fuel additives present.

15. An unleaded fuel composition of claim 1 comprising:
about 20 volume % ethanol
about 10 volume % toluene;
about 53 volume % branched paraffins; and
about 17 volume % olefins,
based on the total volume of the fuel composition excluding any fuel additives present.

16. An unleaded fuel composition of claim 1 comprising:
about 20 volume % ethanol
about 34 volume % toluene;
about 29 volume % branched paraffins;
about 17 volume % olefins,
based on the total volume of the fuel composition excluding any fuel additives present.

17. The unleaded fuel composition of claim 1 wherein the olefins are selected from the group consisting of di-isobutylene, 2-methyl-2-butene, and mixtures thereof.

18. A method for increasing engine efficiency, the method comprising burning the unleaded fuel composition of claim 1 in an engine.

19. A method for reducing the brake specific fuel consumption of an engine, the method comprising burning the unleaded fuel composition of claim 1 in an engine.

* * * * *